United States Patent [19]

Barclay et al.

[11] Patent Number: 4,608,511

[45] Date of Patent: Aug. 26, 1986

[54] ENERGY FILTER FOR A GEIGER-MÜLLER TUBE

[75] Inventors: David Barclay, South Croydon; Peter H. Burgess, Wantage, both of England

[73] Assignee: U.S. Philips Corporation, New York, N.Y.

[21] Appl. No.: 570,116

[22] Filed: Jan. 12, 1984

[30] Foreign Application Priority Data

Jan. 17, 1983 [GB] United Kingdom ..... 8301155

[51] Int. Cl.[4] ..... H01J 47/06; H01J 5/18

[52] U.S. Cl. ..... 313/93; 313/112

[58] Field of Search ..... 313/93, 112

[56] References Cited

U.S. PATENT DOCUMENTS 4,501,989 2/1985 von der Brake ..... 313/93

FOREIGN PATENT DOCUMENTS 2097640 11/1982 United Kingdom .

*Primary Examiner*—Palmer C. DeMeo

*Attorney, Agent, or Firm*—Paul R. Miller

[57] ABSTRACT

A gamma ray energy filter for a improving the uniformity of response of a Geiger-Müller tube comprises only two spaced filter bodies. To improve the uniformity of the energy response, the two filter bodies consist of a lead/tin alloy containing substantially less than 95% but not substantially less than 40%, and suitably 50–60%, of lead. To improve the polar response particularly in directions away from the normal to the longitudinal axis of the tube, and at quite low energies, adjacent edges of the filter bodies are inclined to the longitudinal axis over a majority of their radial thickness at less than 45°, and circumferentially-spaced apertures with axes inclined to the longitudinal axis are provided in at least one of the bodies.

19 Claims, 2 Drawing Figures

ENERGY FILTER FOR A GEIGER-MüLLER TUBE

The invention relates to a γ-ray energy filter for a Geiger-Müller tube (hereinafter alternatively referred to for brevity as a G-M tube).

BACKGROUND OF THE INVENTION

G-M tubes are used to detect ionising radiation and in particular may be operable to detect electromagnetic radiation (γ-rays) resulting from the decay of radioactive material, for example in the energy range of 50 keV–1.3 MeV. The sensitivity of an unshielded G-M tube, typically expresses as the number of counts per roentgen, varies significantly with energy within this range, for example from around 400 keV downwards and especially below about 200 keV.

It is known to provide an energy filter aobut a G-M tube to reduce the variation of sensitivity of the tube with the energy of incident γ-radiation. A filter known from the paper "A Geiger-Müller γ-Ray Dosimeter With Low Neutron Sensitivity" by E. B. Wagner and G. S. Hurst, Health Physics, Vol. 5, pages 20–26 (1961) comprises two successive annular layers respectively of tin and lead around the tube (which, as is usual, is elongated and substantially rotationally symmetrical) and two successive discs respectively of tin and lead abutting the annular layers adjacent one axial end of the tube, these materials being mounted within a synthetic plastics (fluorothene) jacket. This arrangement is said to make the counter (Philips type number 18509, now available as Mullard type ZP 1310) furnish readings of exposure dose in roentgens that are essentially independent of γ-ray energies down to 150 keV; a graph in the paper indicates a falling response from about 300 keV downwards.

Other known filters, proposed for use with Mullard (registered Trade Mark) G-M tubes, each comprise two longitudinally-separated annular bodies about the tube and a disc adjacent one axial end of the tube; the disc is separated by a gap from the adjacent annular body, and for tubes having a protrusion at that end, has a central aperture into which the protrusion extends. The disc consists of tin, and the annular bodies consist either of tin or of two layers respectively of ten and lead. As in the filter first mentioned above, the energy-absorbing elements of the filter are mounted in a synthetic plastics jacket. The surfaces of the annular bodies bounding the gap therebetween are inclined away from each other at an angle to the longitudinal axis of the tube varying (from one filter to another) from 70° and down to 45°.

In a combination of a filter and a G-M tube fitted therein available as Mullard type ZP 1311, the filter consists of two identical, longitudinally spaced bodies of tin, each comprising an annular portion and, contiguous with one end thereof, a disc portion with a central aperture. The adjacent surfaces of the annular portions bounding the gap between the two bodies are curved substantially in the form of a quadrant of a circle.

Yet another filter is known from published U.K. patent application GB No. 2 097 640 A. This filter comprises a copper sheath and attached thereabout a discontinuous jacket of a 60/40 tin-lead alloy in the form of two axially-spaced rings and one disc at one end of the sheath, the disc being spaced from the adjacent ring. The surfaces of the rings which define the annular gap therebetween are depicted as being inclined away from each other at an angle to the longitudinal axis of the tube of about 60°.

SUMMARY OF THE INVENTION

The invention provides a γ-ray energy filter for an elongated Geiger-Müller tube having a longitudinal axis, wherein for substantially absorbing γ-ray energy within the range of energies to be detected by the tube, the filter comprises two and only two filter bodies with each filter body having a respective substantially annular portion for surrounding the tube substantially coaxially therewith, wherein in use the bodies are spaced from one another by a longitudinal gap with the substantially annular portions extending longitudinally from the gap so as to permit the incidence of γ-rays on part of the tube without substantial absorbtion, wherein the surfaces of the substantially annular portions which bound the gap are shaped so that they each extend away from one another in the same radial sense at an angle to the longitudinal axis of substantially less than 45° over at least a substantial majority of the radial thickness of the respective substantially annular portion, wherein at least one of the bodies has a plurality of circumferentially-spaced apertures extending from the inside to the outside of the filter with each of plurality of apertures having a respective axis which is disposed so as to be inclined to the longitudinal axis at an angle differing substantially from 0° and from 90°, and wherein both bodies are of an alloy which consists essentially of tin and lead and in which the proportion of lead is substantially less than 95% but not substantially less than 40%.

Our experiments have indicated that such an alloy formed into two (and only two) spaced bodies constitutes a particularly appropriate composition and basic configuration for a filter which enables the net or effective response of a G-M tube to have a good degree of uniformity with energy and furthermore to extend to quite low energies, and that the shaping of the surfaces of the substantially annular portions bounding the gap therebetween and the provision of the circumferentially-spaced apertures with axes inclined to the longitudinal axis enable a good response to be obtained in directions well away from the normal to the longitudinal axis, particularly at quite low energies. Moreover, as the filter comprises only two bodies, the manufacture of the filter can be quite simple.

The angle of substantially less than 45° may be substantially 30°.

Suitably, the apertures are disposed at an end of one body which in use is remote from the other body. The angle to the longitudinal axis at which the respective axis of each aperture is inclined may be substantially 45°.

For particularly simple manufacture of the filter, the internal and external dimensions of the two bodies may be substantially the same. Nevertheless, the two bodies may differ from one another in respect of one or more apertures extending from the inside to the outside of the filter, particularly for improving the polar response of a G-M tube of which the two portions respectively surrounded by the two filter bodies are not the same.

In a filter wherein each of the filter bodies has, contiguous with the end of the respective annular portion that in use is remote from the other filter body, a further respective portion disposed so as to extend inward from the annular portion towards the longitudinal axis, and wherein the respective internal and external dimensions of the two bodies are substantially the same, the thickness of at least the majority of each inward-extending portion may be substantially less than the thickness of at least the majority of each substantially annular portion. This can improve the polar response over a moderate range of angles about the longitudinal axis.

To improve the response to radiation incident on the tube at fairly small angles to the longitudinal axis (in both directions, i.e. at angles fairly close to 0° and to 180° measured in the same sense), it has been found preferable for each of two filter bodies comprising an annular portion also to have an axial end portion with a central aperture, enabling both bodies to be made with the same outline shape of the combination of the annular portion and the end portion, while also permitting radiation to be directly incident at small inclinations to the axis on the ends of the tube. In such a filter for a Geiger-Müller tube having an electrode connection extending substantially axially outside the envelope of the tube, wherein the electrode connection extends through the central aperture in one of the filter bodies, the central aperture in the one filter body may be substantially larger than the central aperture in the other filter body. This is particularly suitable for improving the sensitivity of the tube to radiation incident on the one filter body at small angles to the longitudinal axis, i.e. close to the electrode connection. In that case, to further improve the uniformity of response in directions well away from both the longitudinal axis and the normal thereto, the plurality of circumferentially-spaced apertures may be present in the other filter body but absent from the one filter body.

In a filter wherein each of the filter bodies has, contiguous with the end of the respective annular portion which is remote from the other filter body, a further respective portion disposed so as to extend inwardly from the annular portion towards the longitudinal axis, each body may be of substantially reduced thickness at and adjacent the junction of the substantially annular portion and the inwardly-extending portion so as to improve the polar response of the tube in directions well away from the normal to the longitudinal axis. The outer surface of each body at and adjacent the junction may be shaped so as to be inclined to the longitudinal axis at substantially 45°.

It has been found particularly suitable for the proportion of lead in the tin/lead alloy of the filter bodies to be substantially in the range of 50–60%. (An alloy of 95% lead with 5% antimony was unsuitable.)

A filter embodying the invention may be mounted on the tube with locating means for determining the relative positions of the filter bodies and tube with the locating means having a very small energy absorbtion compared with that of the filter in the range of energies to be detected by the tube and having longitudinally-spaced surfaces extending normal to the longitudinal axis of the tube to define the gap between the two filter bodyes, wherein over a substantial but minor proportion of the radial thickness of the respective substantially annular portions, the surfaces of the substantially annular portions that bound the gap extend normal to the longitudinal axis of the tube and abut the normally-extending surfaces of the locating means.

BRIEF DESCRIPTION OF THE DRAWINGS

An embodiment of the invention will now be described, by way of example, with reference to the diagrammatic drawings, in which.

DESCRIPTION OF PREFERRED EMBODIMENTS

Figure 1:
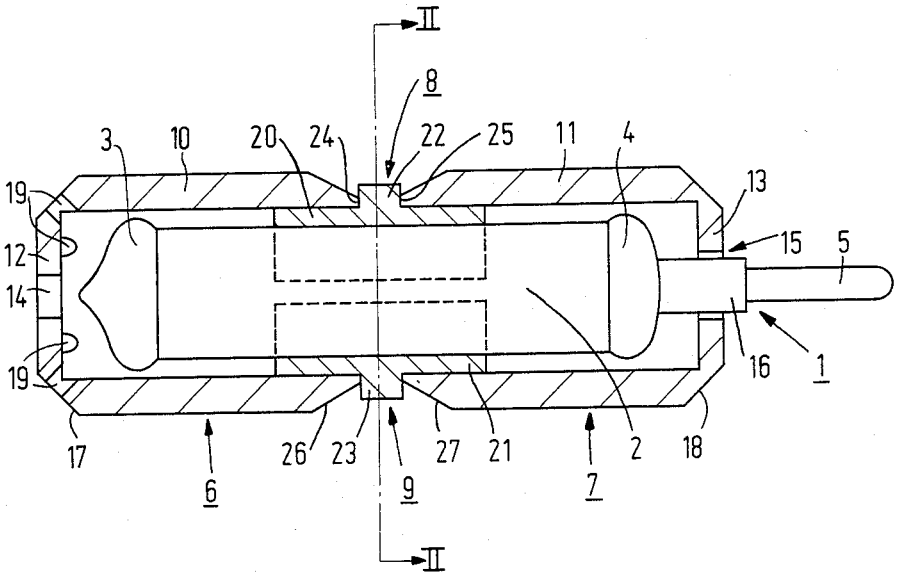
FIG. 1 is a side view of a Geiger-Müller tube and a cross-section, taken in a plane including the longitudinal axis of the tube, of a filter embodying the invention and of spacer members for locating the filter about the tube.
Figure 2:
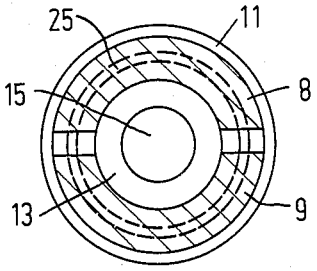
FIG. 2 is an axial cross-section, in the palne II—II in FIG. 1, from which some details, particularly those of the tube, have been omitted for clarity and simplicity.

Referring to the drawings, an elongated Geiger-Müller tube 1 comprises a hollow cylindrical shromium-iron cathode 2 sealed at each end with glass seals 3, 4 respectively to form the envelope of the tube. An anode (not shown) extends within the envelope along the longitudinal axis of the tube with a conductive pin 5 extending outside the envelope at one end thereof along the tube axis to provide a connection to the anode.

An energy filter for the tube 1 is formed by two metal bodies, 6 and 7 respectively, disposed about the envelope of the tube with the relative positions of the bodies 6 and 7 and the tube 1, both radially and longitudinally, being determined by means of two spacer members, 8 and 9 respectively, of synthetic plastics material. Each of the bodies 6, 7 comprises a respective annular portion 10, 11 and, contiguous with the end of the annular portion remote from the other body, a respective disc-like end portion 12, 13 extending inwardly from the annular portion towards the longitudinal axis of the tube adjacent a respective end of the envelope of the tube. Each of the end portions 12, 13 has a respective central aperture 14, 15 with the pin 5 extending through the aperture 15 and being surrounded in the region of the aperture by an electrically insulating sleeve 16. The tube 1 and the filter bodies 6 and 7 have rotational symmetry. The bodies 6 and 7 have substantially the same internal and external dimensions, thus simplifying manufacture. The end portions 12 and 13 are thinner than the annular portions 10 and 11 over the major portions therof. Each body is of reduced thickness at and adjacent to the junction of its annular portion and its end portion with the outer surface of the body in the region of the junction being inclined to the longitudinal axis at 45°, as shown at 17, 18 respectively. Although the bodies have the same outline shape and size, they differ with respect to the diameters of the apertures 14, 15 and by the presence of a plurality of further apertures, as indicated at 19, disposed about the longitudinal axis at the junction of the annular portion 10 and the end portion 12 of the filter body 6 with the axis of each of the apertures 19 being inclined to the longitudinal axis at 45°. Radiation may be incident through the apertures on the glass rather than the metal portion of the tube envelope.

Each of the spacer members 8, 9 comprises a respective longitudinal portion 20, 21 which is contiguous with the outer surface of the cathode 2 and which extends almost half-way therearound (so that there are two diametrically-opposed narrow gaps between the members), and a respective flange portion 22, 23 which is disposed mid-way along the longitudinal portion and which extends radially outward therefrom with the radially-extending faces of each flange portion being normal to the longitudinal axis of the tube. At their adjacent ends, the filter bodies 6, 7 have surfaces that over a substantial but minor proportion of the radial thickness of the annular portions of the filter bodies extend radially outwardly from the longitudinal portions 20, 21 of the spacer members, normal to the longitudinal axis of the tube, and abut the radial faces of the flange portions 22, 23 of the spacer members as indicated at 24, 25, so that the longitudinal thickness of the flange portions 22, 23 determines the width of the gap between the filter bodies 6, 7. Thereafter, over a substantial majority of the radial thickness of the annular portions of the filter bodies, the surfaces at the adjacent ends of the filter bodies each continue extending radially outwardly but also away from aonther at an angle to the longitudinal axis of substantially less than 90° (so that the included angle between the surface is substantially greater than 90°), as indicated at 26, 27.

Both of the bodies 6 and 7 are of an alloy which consists essentially of tin and lead and in which the proportion of lead is substantially less than 95% but not substantially less than 40%.

A filter embodying the invention, substantially as described above with reference to the drawings, has been made of the use with the Mullard ZP 1310 G-M tube. The alloy of the filter bodies consisted essentially of substantially equal proportions of tin and lead. Polar diagrams for the combination of the tube and filter were taken at 45, 65, 83, 100, 118, 161, 205, 248, 660 and 1250 keV. At broadside, i.e. in a plane normal to the longitudinal axis of tube and filter, the energy response with reference to the response for $^{137}Cs$ (660 keV) was within ±20% from 50 keV to 1250 keV, and within ±10% from 300 keV to 1250 keV. The polar response, angles being measured with reference to broadside, was as follows:

within ±20% over ±45° from 48 keV to 1250 kev, and also within −20% of the maximum response over ±45° from 48 keV to 1250 keV;

from 45° to 90° from braodside towards the end opposite to that with the anode pin, within −50% of the maximum response from 48 keV to 1250 keV;

from 45° to 60° from broadside towards the end with the anode pin, within −50% of the maximum response from 48 keV to 1250 keV;

from 45° to 80° from broadside towards the end with the anode pin, within −50% of the maximum response from 65 keV to 1250 keV;

from 45° to 90° from broadside towards the end with the anode pin, within −50% of the maximum response from 83 keV to 1250 keV.

This substantially meets the performance specified by the International Electrotechnical Commission (IEC) in the IEC Recommendation of Publication 395 (1st Edition, 1972) for portable dosimetric equipment, and by the Physikalisch-Technische Bundesanstalt (PTB) in Germany.

We claim:

1. A γ-ray energy filter for an elongated Geiger-Müller tube having a longitudinal axis, said filter comprising two filter bodies each having an annular portion for coaxially surrounding the Geiger-Müller tube, said two filter bodies substantially absorbing γ-ray energy within a range of energies to be detected, wherein said two filter bodies are spaced by a longitudinal gap from one another in the longitudinal direction to permit said rays to be incident on part of said Geiger-Müller tube without substantial absorbtion, said annular portions of said two filter bodies extending in said longitudinal direction from said longitudinal gap, said annular portions having surfaces at said longitudinal gaps extending away from one another in the same radial sense at an angle to said longitudinal axis of less than 45° over a portion of the radial thickness of said annular portions, wherein at least one of said filter bodies has a plurality of circumferentially spaced apertures extending through said at least one filter body, each of said plurality of apertures having an axis disposed at an inclination to said longitudinal axis at an angle differing from 0° and from 90°, and wherein said two filter bodies are of an alloy consisting essentially of tin and lead with the proportion of lead being less than 95% but not substantially less than 40%.

2. A filter according to claim 1, wherein said angle less than 45° is approximately 30°.

3. A filter according to claim 1 or claim 2, wherein said apertures are disposed at an end of said at least one filter body, said end being remote from the other of said filter bodies.

4. A filter according to claim 3, wherein each of said apertures is inclined at an angle of 45° to said longitudinal axis.

5. A filter according to claim 4, wherein said two filter bodies have substantially the same internal and external dimensions.

6. A filter according to claim 5, wherein said two filter bodies differ from one another with respect to the number of said apertures.

7. a filter according to claim 6, wherein only one of said two filter bodies has said plurality of apertures.

8. A filter according to claim 5, wherein each of said two filter bodies has a portion extending inwardly and contiguously from said annular portion toward said longitudinal axis at an end of said annular portion remote from the other said annular portion, and wherein the inwardly extending portion has a thicness less than each of said annular portions.

9. A filter according to claim 1, wherein each of said apertures is inclines at an angle of 45° to said longitudinal axis.

10. A filter according to claim 1, wherein said two filter bodies have substantially the same internal and external dimensions.

11. A filter according to claim 10, wherein said two filter bodies differ from one another with respect to the number of said apertures.

12. A filter according to claim 11, wherein only one of said two filter bodies has said plurality of apertures.

13. A filter according to claim 10, wherein each of said two filter bodies has a portion extending inwardly and contiguously from said annular portion toward said longitudinal axis at an end of said annular portion remote from the other said annular portion, and wherein the inwardly extending portion has a thickness less than each of said annular portions.

14. A filter according to claim 1, wherein each of said filter bodies has a further portion disposed to extend inwardly from said annular portion toward said longitudinal axis, said further portion being contiguous to an end of said annular portions remote from the other, and wherein each of said filter bodies is of reduced thickness at and adjacent to the junction of said annular portion and said further portion.

15. A filter according to claim 14, wherein each of said filter bodies has an outer surface at said junction inclined to said longitudinal axis at 45°.

16. A filter according to claim 1, wherein said alloy contains lead in a proportion in the range of 50–60%.

17. A filter according to claim 1, wherein each of said filter bodies has a further portion disposed to extend inwardly from said annular portion toward said longitudinal axis, said further portion being contiguous with an end of said annular portion remote from the other annular portion, and wherein each of said inwardly extending further portions has a respective central aperture with the central aperture in one said filter body being substantially larger than the central aperture in the other of said filter bodies, and wherein an electode of said Geiger-Müller tube extends through said central aperture in said one filter body.

18. A filter according to claim 17, wherein only said other of said filter bodies has a plurality of said apertures circumferentially spaced about said other filter body.

19. A filter according to claim 1, further comprising locating means for determining relative positions of said two filter bodies and said Geiger-Müller tube, said locating means having a very small energy absorbtion compared to that of said two filter bodies in said range of energies to be detected, wherein said locating means have longitudinally spaced surfaces extending normally to said longitudinal axis to define said longitudinal gap between said two filter bodies, and wherein said surfaces of said annular portions at said longitudinal gap extend normally to said longitudinal axis and abut said longitudinally spaced surfaces of said locating means over at least a portion of the radial thickness of said annular portions.

* * * * *

UNITED STATES PATENT AND TRADEMARK OFFICE

CERTIFICATE OF CORRECTION

PATENT NO. : 4,608,511

DATED : August 26, 1986

INVENTOR(S) : DAVID BARCLAY ET AL

It is certified that error appears in the above-identified patent and that said Letters Patent is hereby corrected as shown below:

IN THE CLAIMS:

Claim 7, line 1, change "a" to --A--.

Claim 8, line 6, change "thicness" to --thickness--.

Signed and Sealed this

Thirtieth Day of December, 1986

*Attest:*

DONALD J. QUIGG

*Attesting Officer* *Commissioner of Patents and Trademarks*